US007500299B2

(12) United States Patent
Dupeux et al.

(10) Patent No.: US 7,500,299 B2
(45) Date of Patent: Mar. 10, 2009

(54) METHOD FOR INTRODUCING A DELIBERATE MISMATCH ON A TURBOMACHINE BLADED WHEEL AND BLADED WHEEL WITH A DELIBERATE MISMATCH

(75) Inventors: Jérôme Dupeux, Vaux le Penil (FR); Christian Dupont, Dammarie les Lys (FR); Jean-Pierre Lombard, Pamfou (FR); Eric Seinturier, Bruges (FR)

(73) Assignee: SNECMA, Paris (FR)

( * ) Notice: Subject to any disclaimer, the term of this patent is extended or adjusted under 35 U.S.C. 154(b) by 585 days.

(21) Appl. No.: 11/107,877

(22) Filed: Apr. 18, 2005

(65) Prior Publication Data

US 2005/0249586 A1 Nov. 10, 2005

(30) Foreign Application Priority Data

Apr. 20, 2004 (FR) ..... 04 04130

(51) Int. Cl.
*F01D 5/00* (2006.01)
*F01D 25/06* (2006.01)

(52) U.S. Cl. ..... 29/407.07; 29/889; 29/889.1; 29/889.21; 416/61; 416/144; 416/175; 416/203; 416/500; 415/118; 415/119; 73/455; 73/660; 700/98; 700/118; 702/56

(58) Field of Classification Search ..... 415/118, 415/119; 416/61, 144, 145, 175, 203, 500; 29/407.05, 407.07, 889, 889.1, 889.21, 889.22; 73/455, 660; 700/95, 97, 98, 117, 118; 702/56
See application file for complete search history.

(56) References Cited

U.S. PATENT DOCUMENTS

| | | | | |
|---|---|---|---|---|
| 4,097,192 | A * | 6/1978 | Kulina | 416/175 |
| 5,993,161 | A | 11/1999 | Shapiro | |
| 6,854,959 | B2 * | 2/2005 | Barb | 416/175 |
| 7,082,371 | B2 * | 7/2006 | Griffin et al. | 702/56 |
| 2002/0067991 | A1 * | 6/2002 | Montgomery et al. | 416/203 |

FOREIGN PATENT DOCUMENTS

| | | |
|---|---|---|
| EP | 1 211 382 A2 | 6/2002 |
| WO | WO 98/36966 | 8/1998 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A method to introduce a deliberate mismatch into a turbomachine bladed wheel so as to reduce vibration amplitudes of the wheel in forced response. The method includes a step of determining an optimum value of the standard deviation for the mismatch as a function of operating conditions of the wheel inside the turbomachine, with respect to the maximum vibration amplitude response required on the wheel. The method further includes a step of at least partly placing blades with different natural frequencies on the wheel such that the standard deviation of the frequency distribution of all blades is equal to at least the mismatch value, the mismatch value being determined statistically.

15 Claims, 4 Drawing Sheets

METHOD FOR INTRODUCING A DELIBERATE MISMATCH ON A TURBOMACHINE BLADED WHEEL AND BLADED WHEEL WITH A DELIBERATE MISMATCH

This invention relates to turbomachine rotors, and particularly rotors fitted with blades around their periphery, that are subjected to vibrational phenomena during operation of the turbomachine.

Bladed wheels of turbomachines have a practically cyclically symmetric structure. They are generally composed of a series of geometrically identical sectors, except for a tolerance related to manufacturing tolerances of their various components and their assembly.

Although tolerances generally used for manufacturing of bladed wheels are small, they have significant effects on the dynamics of the structure. Small geometric variations, for example due to manufacturing and assembly of parts, or small variations in properties of the material from which they are made such as their Young's modulus or their density, can lead to small variations in the natural resonant frequency from one blade to another.

These variations are denoted by the term mismatch and are very difficult to control; the expression "accidental mismatch" is used in this case. These small frequency variations from blade to blade are sufficient to make the structure non-symmetric. The wheel is said to be mismatched. A variation with a standard deviation of 0.5% of even less between the natural frequencies of blades is sufficient to make the wheel mismatched.

On a mismatched bladed wheel, it is found that the vibrational energy is located on one or a few blades instead of being distributed around the entire wheel. The consequence of this positioning is amplification of the forced response. This term refers to the vibrational response to an external excitation.

External excitation on a turbomachine, particularly an aeronautical machine, is usually caused by asymmetry in the aerodynamic flow. For example, it may be due to an upstream side stator or a downstream side stator, a distortion, taking off air in the compressor, reinjected air, the combustion chamber or the structural arms.

Blade to blade response levels may vary by a factor of 10 and the maximum on the bladed wheel may be twice or even three times as much as would have been obtained on the perfectly symmetric wheel.

The variation in the response to an excitation source as a function of the mismatch follows a curve like that shown in FIG. 1. It shows the maximum vibration amplitude response of the bladed wheel determined for different values of the standard deviation of natural frequencies of blades distributed around the wheel. For a mismatch of 0%, the response is normalised to 1. The normal standard deviation of the mismatch encountered on wheels during use is of the order of 0.5%. This graph shows that this is generally the worst case. Attempting to reduce it to become closer to symmetry is very expensive, particularly because this denotes a reduction in manufacturing tolerances. This graph also shows that starting from a given mismatch level b, the effect on the dynamics of the bladed wheel is attenuated and the maximum levels observed on the wheel reduce.

The purpose of the invention is to introduce a deliberate mismatch on the bladed wheel so as to reduce the maximum response on the wheel, and no longer depend on the small accidental mismatch that is always present.

The method according to the invention to introduce a deliberate mismatch into a turbomachine bladed wheel so as to reduce vibration amplitudes of the wheel in forced response, is characterised by the fact that it consists of determining an optimum value of the mismatch as a function of operating conditions of the wheel in the said turbomachine, corresponding to a maximum required vibration amplitude response, and of at least partly placing blades with different natural frequencies on the said wheel such that the standard deviation of the frequency distribution of all blades is equal to at least the said mismatch value, the said mismatch value being determined by a statistical calculation method.

The standard deviation of the deliberate mismatch introduced is advantageously greater than this optimum value b.

The value b depends on the wheel being studied, the stiffness of the disk and the value of damping present on the bladed wheel. It can be considered that in most cases, the value of b is a standard deviation of the frequency of the order of 1 to 2%. In these cases, the typical deviation of the deliberate mismatch introduced is more than 2%.

The Campbell's diagram is intended to determine the frequency situation of the structure with regard to possible excitations. Frequencies of vibration modes of the bladed wheel as a function of the rotation speed of the wheel, and the possible excitation frequencies are shown on this diagram. Intersections between these two types of curves correspond to resonance.

One example excitation source consists of an upstream stator comprising N blades. The excitation with frequency $f=N\omega$ is monitored on the downstream side of the stator, where $\omega$ is the rotation frequency of the rotor. In the context of a turbomachine design, the geometric and structural parameters of the mobile wheel concerned are determined so as to shift resonance outside the operating range with a safety margin.

For example, consider the Campbell's diagram in FIG. 2 in which the ordinate represents the vibration frequencies of the wheel being examined, and the abscissa represents the rotation frequencies of the wheel. The frequencies for four vibration modes and the straight lines corresponding to the excitation frequencies for two orders, N1 and N2, are shown as a function of the rotation frequency.

Mode No. 1 is excited by order N1 with a sufficient margin outside the operating range of the turbomachine.

Mode No. 2 is not excited by order N1; the margin is sufficient.

Mode No. 3 is excited by order N2 below the operating range of the turbomachine with a sufficient margin.

Mode No. 4 is excited by order N2 in the operating range of the wheel.

This resonance may not be acceptable, depending on the mode type.

Therefore, it is obvious that it is difficult to find an acceptable compromise.

For example, if it is required to improve the situation for the Mode 4/order N2 resonance, introducing a deliberate mismatch of b % will spread the frequencies of the bladed wheel about their average value. Instead of having one line per mode, there is one band per mode. The band width depends on the mode: a deliberate mismatch of b % for one frequency will not necessarily introduce a variation of b % in the other frequencies.

This is much more restrictive for the design since the possible resonance ranges are wider. For example in the previous case, modes 1 to 3 that respected the frequency margins in the matched case no longer respect them.

Therefore, the purpose of the invention is also to determine the minimum value b to have a significant effect on vibration amplitudes, while spreading structural modes as little as possible to facilitate the structure design.

With reference to FIG. 1, the problem that the invention is intended to solve consists of determining the corresponding value of b on the curve for a given maximum vibration amplitude value.

As mentioned above, the said mismatch value is determined using a statistical calculation method.

This method includes the following steps:

- a first value of the mismatch standard deviation $\sigma_j$ is defined,
- a statistically significant number R of random mismatch distributions is generated within this standard deviation $\sigma_j$,
- for each of the R random distributions, the forced mismatched response is calculated as a function of the operating conditions of the wheel inside the turbomachine,
- the maximum value is extracted from it,
- another value of $\sigma_j$ is chosen, and a sufficient number of iterations of the previous calculation is carried out to plot response values as a function of the values $\sigma_j$.

Another purpose of the invention is a bladed wheel with a deliberate mismatch.

A bladed wheel for which the deliberate mismatch was determined using the method according to the invention has blades with different natural frequencies, the number of different frequencies outside the manufacturing tolerances being not more than 3.

According to another characteristic, the blades are distributed in patterns with blades with natural frequency f1 and blades with natural frequency f2, where f2 is not equal to f1. In particular, successive patterns are identical, similar or have a slight variation from one pattern to another.

According to another characteristic, each pattern comprises (s1+s2) blades, s1 blades with frequency f1 and s2 blades with frequency f2. In particular, s1=s2 and s1 is not larger than the total number N of blades in the wheel divided by 4. In particular, each pattern comprises (s1+s2+/−1) blades including (s1+/−1) blades with frequency f1 and (s2+/−1) blades with frequency f2.

According to another characteristic, in which the wheel is subjected to a harmonic excitation n less than the number N of blades in the wheel divided by two (n<N/2), the blades are distributed in n identical patterns or with a slight variation from one pattern to the next.

According to another characteristic, in which the wheel is subjected to a harmonic excitation n greater than the number N of blades in the wheel divided by two (n>N/2), the number of patterns is equal to the number of diameters in the mode concerned.

The invention is described in more detail below with reference to the drawings in which:

FIG. 1 shows the plot of the value of the maximum vibration amplitude response with respect to the mismatch expressed as a standard deviation of the natural frequencies, FIG. 2 shows an example Campbell diagram, FIG. 3 shows a calculation flowchart for plotting the curve of the forced response as a function of the standard deviation of natural vibration frequencies of the blades, and FIG. 4 shows a bladed wheel on which a deliberate mismatch is introduced according to an embodiment of the present invention.

We will now describe the statistical method used to determine the minimum value to be used for the mismatch in more detail as a function of the characteristics of the bladed wheel to be treated and limit the forced response to coincidence identified in the operating range.

Figure 4:
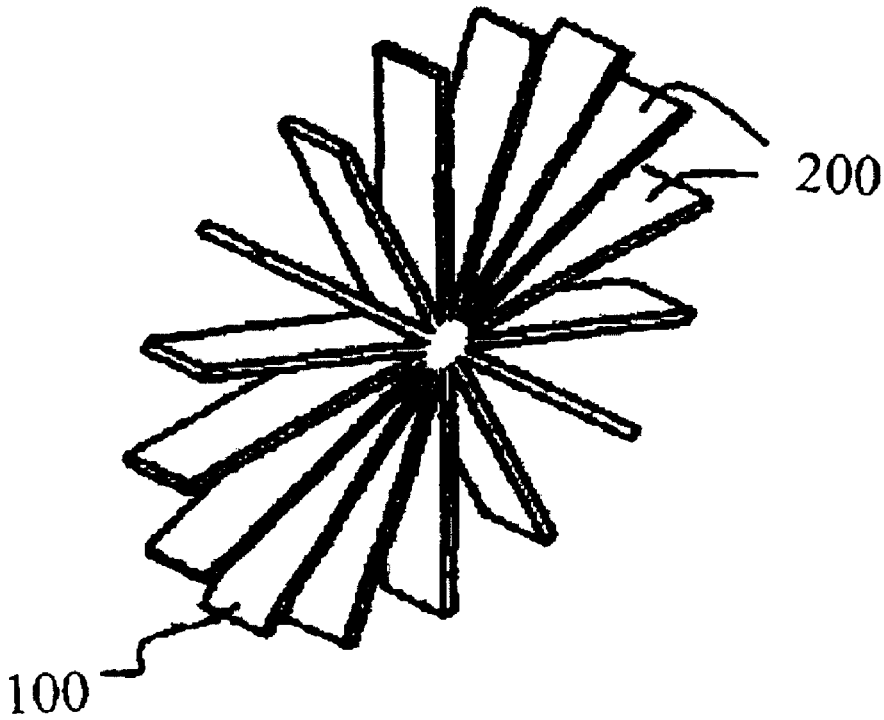
Figure 5:
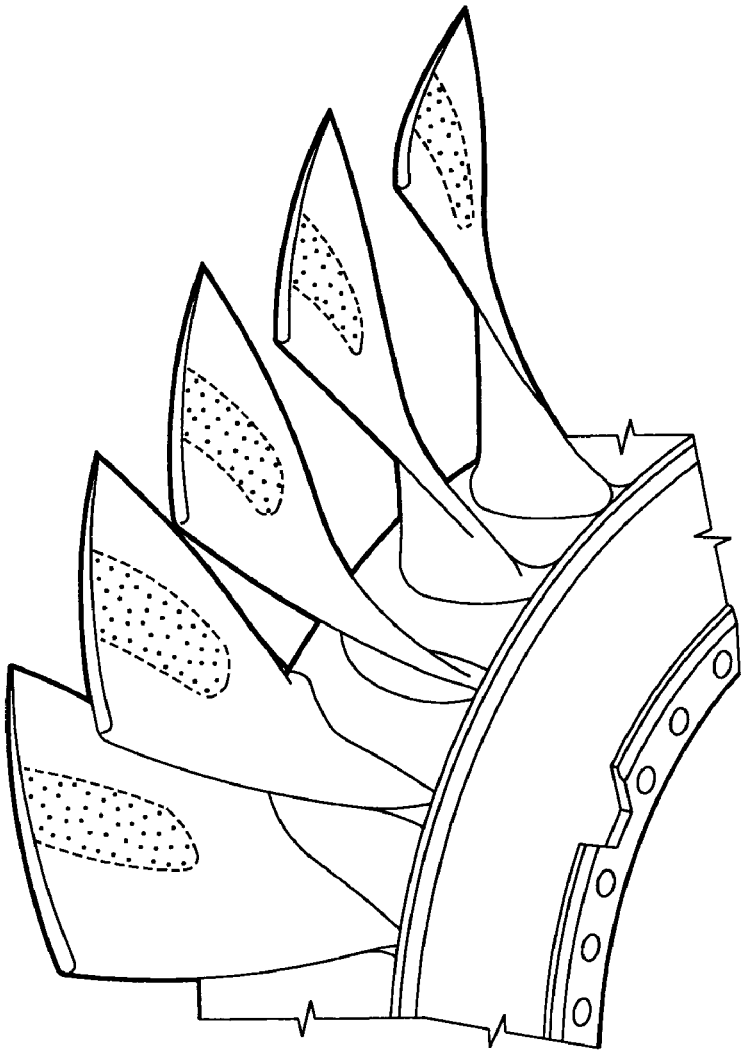
FIG. 5 shows an embodiment of the present invention with hollow or recessed blades and partly filled cavities.
Figure 6:
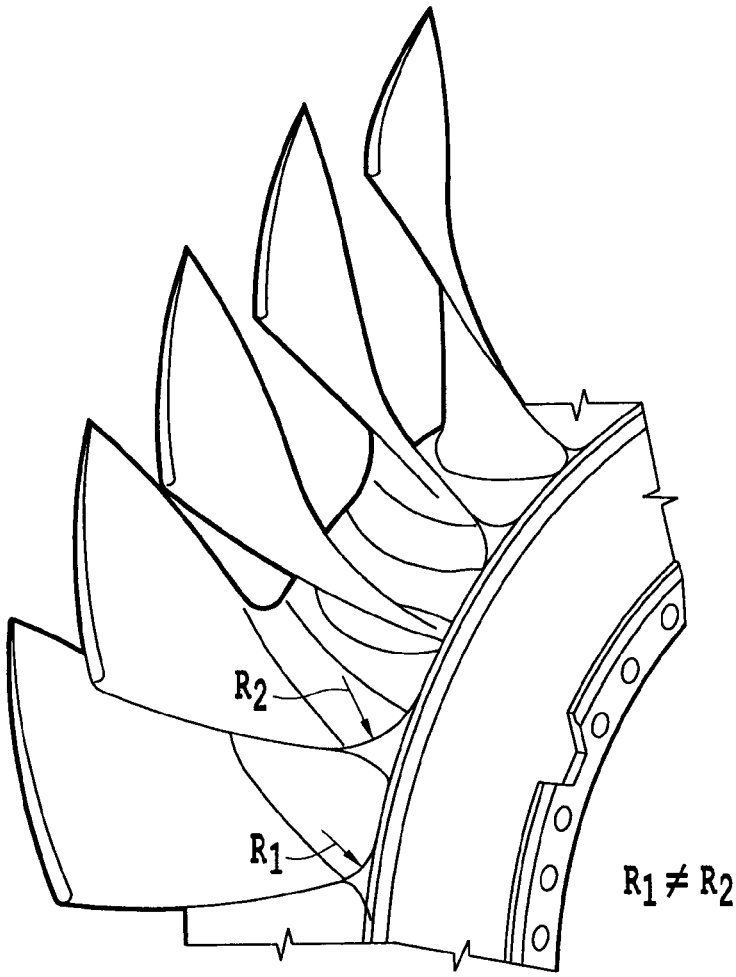
FIG. 6 shows an embodiment of the present invention with fillets between the blades and the hub varying from one blade to the next.

During step 10, an initial value $\sigma_j$ of the standard deviation of mismatch frequencies is chosen. For a bladed wheel 100 (FIG. 4), this is the average of the deviations between the natural vibration frequency of each blade 200 and the average frequency. It is found that the variation of natural frequencies for blades only is taken into account. It is accepted that modes for disks remain cyclically symmetric.

In step 20, a distribution $R_i$ is digitally generated at random. For a predefined value of the standard deviation $\sigma_j$ of a bladed wheel, there is an infinite number of distributions $R_i$ of blades on the wheel $MR_i$, and of natural frequencies of these blades satisfying this standard deviation condition $\sigma_j$.

In step 30, the determination for this distribution $R_i$ is made using a known numeric method for calculating the amplitude response to an excitation. For example, for a turbojet compressor it could be a response to distortions in the incident flow resulting from cross-wind.

The response of each blade to the external disturbance for the wheel with distribution $R_i$ is determined in this way. The maximum value $R_i$max $\sigma_j$ is extracted in step 40, and is expressed with respect to the response obtained on a blade of a perfectly matched wheel. This value is more than 1, and is usually less than 3.

A loop back to step 20 is made in step 42 by determining a new distribution $R_{i+1}$, and the calculation is restarted to determine a new value $R_{i+1}$max $\sigma_j$. The calculations are repeated for number R of distributions. This number R is chosen as being statistically significant.

In step 50, the maximum $M\sigma_j$ of values $R_i$max $\sigma_j$ is extracted for all R distributions. All values $R_i$max are used to determine the maximum amplification value that statistically would not be exceeded in more than a fixed percentage of cases, for example 99.99%. This result is achieved by marking the values on an accumulated probability curve. The scatter diagram is advantageously smoothed by a Weibull probability plot that reduces the number of required draws, for example to 150.

Figure 3:
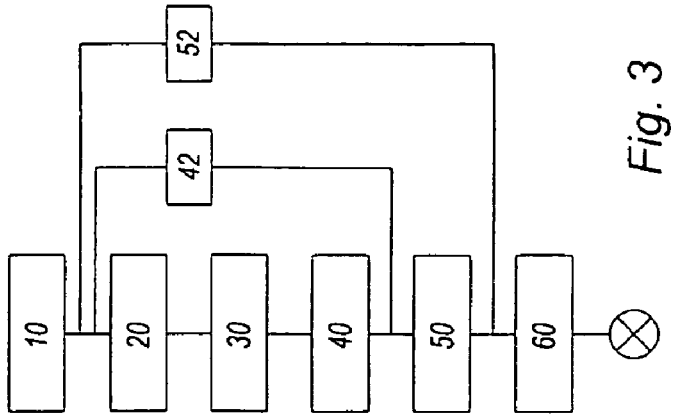
Figure 1:
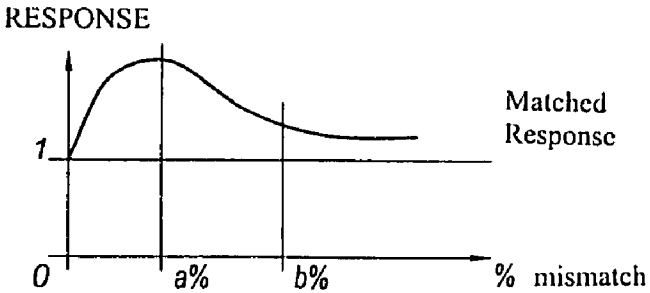

Thus, the point $M\sigma_j$ corresponding to a value of the standard deviation $\sigma_j$ was determined on the diagram in FIG. 1.

A new value $\sigma_{j+1}$ is fixed in step 52, and is used as a starting point for a loop back to step 10 to calculate a new value M $\sigma_{j+1}$.

In step 60, there is a sufficient number of points to plot the curve in FIG. 1, namely $M\sigma_j=f(\sigma_j)$.

Once the curve in FIG. 1 has been plotted, it is easy to fix the optimum value b of the standard deviation as a function of the maximum allowable amplitude.

Figure 2:
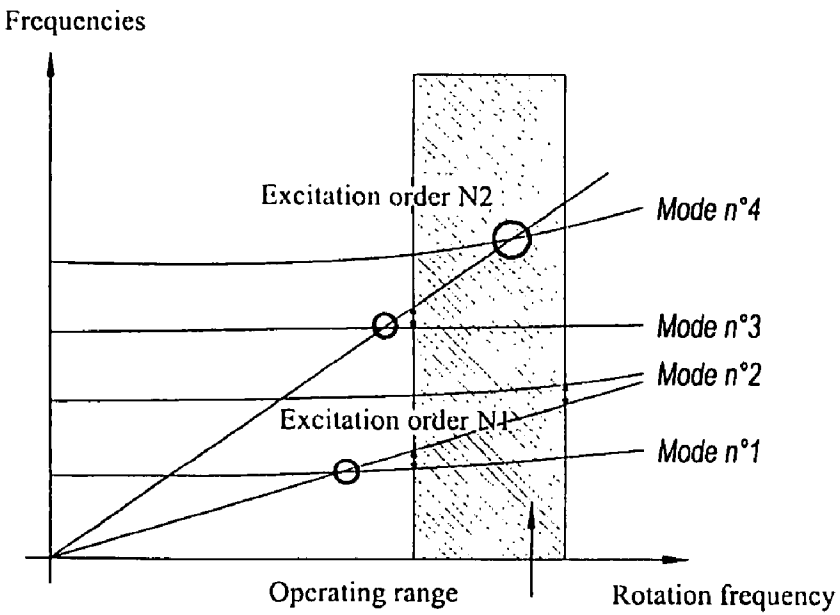

The largest possible value of b could be chosen taking account of the shape of the curve beyond the maximum. However, the choice is limited by the fact that introducing a mismatch within the context of an improvement to the situation for a particular resonance is equivalent to widening the resonance ranges for other modes, as can be seen on the Campbell diagram in FIG. 2.

According to another characteristic of the invention, it is checked that introducing a deliberate mismatch improves the aeroelastic stability of the wheel. The average of the damping coefficients corresponding to each possible phase angle between the blades is calculated, and it is checked that the mode concerned by floating is less than the said average.

In other words, if the engine test indicates that floating margins are insufficient, it might then be useful to introduce a deliberate mismatch.

The method includes the following steps:

1—It is assumed that the bladed wheel is matched;

2—an aeroelastic stability calculation is made for each possible phase angle between the blades, using appropriate numeric tools: Navier Stokes in subsonic or possibly Euler in supersonic; 2D or 3D approach;

3—the aeroelastic damping coefficient corresponding to each phase angle is calculated;

4—average damping coefficients are calculated;

5—if the damping coefficient of the mode concerned by floating is below this average, it is beneficial to introduce a deliberate mismatch. The optimum mismatch is then determined. Otherwise, there is apparently no need to perform such a mismatch since the wheel is sufficiently stable.

In summary, the mismatch is optimised to minimise the forced response to resonance, assuring that the impact on the stability and the Campbell diagram (for other resonances) is acceptable, or the mismatch is optimised with regard to stability, while assuring that the impact on the Campbell diagram is acceptable.

The mismatch translates asymmetry of the structure. Therefore conventional analysis approaches with cyclic symmetry, in which only a single sector of the structure is modelled and the behaviour of the complete wheel is then reconstructed from this model, are not directly applicable.

Considering the asymmetry of the structure, a complete representation (360°) is necessary.

The simplest but also the most expensive approach is to model the complete structure; the size of the model then becomes enormous and difficult to manage, particularly using statistical mismatch approaches.

Therefore, a method has been developed to reduce the size of models. The simplified logic of this method is described below, knowing that many complexities also need to be taken into account, particularly related to the rotation speed:

A) The disk is assumed to have cyclic symmetry; a single disk sector is modelled. Calculations are made for all possible phase shift angles applicable to the boundaries of this sector.

For a bladed wheel with N blades, based on the principle of cyclic symmetry:

if N is even: (N/2)+1 phase shifts are calculated, if N is odd: (N+1)/2 phase shifts are calculated.

This provides a means of obtaining all modes of the symmetric disk.

B) For the blades, modes of a nominal blade isolated from the disk are calculated.

C) A mismatch vector is then introduced representing the variation in frequency from one blade to another, so as to disturb the modes of the nominal blade calculated in B) above.

D) The mismatched bladed wheel is then represented by a combination of disk modes calculated in A) above and the mismatched blade modes calculated in C) (projection on a representation base).

Steps A) and B) take a fairly long time to calculate but the calculation is only made once. However steps C) and D) are very fast, so that fast analyses can be carried out for different mismatch vectors. Therefore, this method is particularly suitable for statistical approaches.

As the number of modes calculated in steps A) and B) increases, the representation base also becomes broader and the result becomes more precise, but the calculation becomes more expensive.

For the forced response.

An aerodynamic force is calculated (non-stationary analysis). There are different methods. The calculation is fairly simple and inexpensive since it is decorrelated from the (mismatched) mode of the structure. A force calculation is sufficient, and this force is then applied to the mismatched structure derived from step D).

For stability.

This case is more complex because non-stationary aerodynamic forces depend on the mismatched mode. The "basic" aeroelastic forces are calculated for each mode in the representation base, for simplification reasons.

The total "mismatched" aeroelastic force is obtained by combining the "basic" forces according to the same superposition rule as that used in step D). (The representation base is the same).

Therefore, the stability calculation requires a large number of fairly expensive non-stationary aerodynamic calculations. On the other hand, mismatch analyses are very fast once the aeroelastic model has been built.

When the value of the mismatch to be introduced into the bladed wheel has been determined, this mismatch is advantageously done using one of the following methods.

Once the value of b has been determined, a distribution of blades on the wheel is selected for which the natural frequencies satisfy the standard deviation b condition.

Advantageously, all blades are positioned symmetrically on the disk, particularly in terms of angle, pitch and axial position. The wheel is asymmetric from the point of view of frequencies only.

Advantageously, the number of different types of blades is limited to two or three.

Consider that three types of blades are available with frequencies equal to f0, f1 and f2. For example, the nominal frequency of the blades is f0, the natural frequency of blades with a higher frequency than f0 is f1, and the natural frequency of blades with a lower frequency than f0 is f2.

According to a first embodiment, the blades are distributed according to the pattern [f1 f1 f1 f2 f2], giving a distribution f1 f1 f2 f2 f1 f1 f2 f2, etc.; on the rotor, there are two blades with frequency f1 alternating with two blades with frequency f2, or according to pattern [f1 f1 f1 f2 f2 f2]; alternation with three blades, etc.

More generally, a pattern of (s1+s2) blades is defined using s1 blades with frequency f1 and s2 blades with frequency f2, repeatedly around the wheel. Even more generally, the successive patterns vary slightly from one pattern to the next, particularly by +/−1 blades or +/−2 blades. For example, 36 blades were distributed according to patterns (4f1 4f2) (5f1 5f2) (4f1 4f2) (5f1 5f2) or according to patterns ((4f1 5f2) (4f1 5f2) (5f1 5f2) (4f1 4f2). Other solutions would be possible.

According to one particular distribution method, s1=s2 and s1 is equal to not more than N/4.

Preferably, with the wheel being subjected to a harmonic n excitation, namely n disturbances per revolution, where n is less than the number N of blades in the wheel divided by two (n<N/2), the blades are arranged with a distribution that tends to have the same order of symmetry as excitation on the wheel. They are distributed in n identical groups, or groups with a distribution that varies little from one group to another.

In particular, if the number of blades is divisible by n, the blades are distributed into n repetitive frequency distribution patterns. Hence, for a wheel with 32 blades excited by 4 disturbances per revolution, blades may for example be arranged according to four identical patterns:

4 times the pattern f1 f1 f1 f1 f2 f2 f2 f2 or
4 times the pattern f2 f1 f1 f2 f2 f2 f1 f1 or
4 times the pattern f1 f1 f2 f2 f1 f1 f2 f2 or
4 times the pattern f1 f2 f2 f2 f2 f1 f1 f1.

Preferably, the average frequency is equal to f0 or is nearly equal to f0.

If the number N of blades is not divisible by the number n of disturbances, patterns are chosen that give a distribution that is as close as possible to a distribution in which N is divisible by n. Thus, for a 36-blade wheel excited by 5 disturbances per revolution, the blades are arranged according to approximately the same patterns: four groups of 7 blades and one group of 8 blades, for example such as (4f1 3f2) (3f1 4f2) (4f1 3f2) (3f1 4f2) and (4f1 4f2). Other distributions could be considered.

According to another embodiment, if the wheel is subjected to a harmonic n excitation, where n is greater than the number N of blades in the wheel divided by two (n>N/2), the blades are distributed around the wheel such that the number of repetitive patterns is equal to the number of diameters of the mode concerned. For example, 24 excitations per revolution on a 32-blade mobile wheel require a dynamic response from the so-called 8-diameter bladed wheel. Therefore, a mismatch distribution with 8 repetitive patterns is used.

There are various technological solutions for modifying the natural vibration frequency of a blade.

The frequency can be modified by varying the material from which the blade is made. This solution provides a means of making geometrically identical blades except for manufacturing tolerances and not modifying the steady aerodynamic flow. For example for metallic blades, the blade is made up from materials with different values of the Young's modulus or different densities. Since the frequencies are related to stiffness to mass ratio, simply changing the material has an impact on the frequencies. For composite blades, the texture of the composite in different zones is varied.

Another range of solutions consists of modifying the root of the blade without affecting the blade; the length or width of the stem, or the shape of the bottom of the blade overlength, or the thickness can be modified. In particular, isolated addition of masses under the blade overlength provides a means of offsetting the frequencies of the first vibration modes.

Other solutions apply to particular geometric modifications of the blade, for example: Hollowing the blade by micro-drilling and then reconstruction of the flowpath using a material with a variable stiffness or a variable mass.

Filling of cavities in hollow blades.

Use of local coatings such as thin ceramics so as to locally add mass in areas with a high deformation kinetic energy to offset the frequencies.

Local modification of the surface condition.

Modification of the blade head by machining a "cat's tongue".

Modification of the blade head by machining a bath shaped cavity.

Modification of stacking laws for blade cuts along a direction perpendicular to its axis.

Use of blades with different lengths.

Modification of the blade/blade overlength connection at the fillet using different fillet radii. It should be noted that the impact on the first frequencies of the blade is significant, while the effect on the steady aerodynamic flow is limited.

The invention claimed is:

1. A method for introducing a deliberate mismatch into a turbomachine bladed wheel so as to reduce vibration amplitudes of the wheel in forced response, the method comprising the steps of:

determining an optimum value of the standard deviation for the mismatch as a function of operating conditions of the wheel inside the turbomachine, with respect to the maximum vibration amplitude response required on the wheel, and at least partly placing blades with different natural frequencies on said wheel such that the standard deviation of the frequency distribution of all blades is equal to at least said mismatch value, wherein said mismatch value is determined statistically including the following steps:

defining a first value of the mismatch standard deviation $\sigma_j$, generating a statistically significant number R of random mismatch distributions within said standard deviation $\sigma_j$, for each of the R random distributions, calculating the forced mismatched response as a function of the operating conditions of the wheel inside the turbomachine, extracting from the forced mismatched response a maximum value, choosing another value of $\sigma_j$, and repeating said calculating and extracting steps a sufficient number of iterations to obtain response values as a function of the values $\sigma_j$.

2. The method according to claim 1, wherein the number of different blade natural frequencies outside manufacturing tolerances is limited to three.

3. The method according to claim 2, comprising distributing blades according to patterns with blades with natural frequency f1 and blades with natural frequency f2, f2 being different from f1.

4. The method according to claim 3, wherein subsequent patterns are similar or vary slightly from one pattern to the next.

5. The method according to claim 4, wherein each pattern includes (s1+s2) blades, s1 blades with frequency f1 and s2 blades with frequency f2.

6. The method according to claim 5, wherein s1=s2 and s1 is not greater than the total number N of blades in the wheel divided by 4.

7. The method according to claim 4, wherein each pattern comprises (s1+s2+/−2) blades, including (s1+/−1) blades with frequency f1 and (s2+/−1) blades with frequency f2.

8. The method according to claim 2, further comprising subjecting the bladed wheel to a harmonic excitation of n disturbances per revolution, wherein n is less than the number N of blades in the bladed wheel divided by two (n<N/2), and distributing the blades in n identical patterns or with a slight variation from one pattern to the next.

9. The method according to claim 1, further comprising subjecting the bladed wheel to a harmonic excitation of n disturbances per revolution, wherein n is greater than a number N of blades in the wheel divided by two (n>N/2), and wherein a number of patterns is equal to a number of diameters in the mode concerned.

10. The method according to claim 2, further comprising modifying the resonant frequency of the blades by geometrically modifying the blades.

11. The method according to claim 2, further comprising modifying the resonant frequency of the blades by geometrically modifying blade roots, the blades not being modified, so as to modify the stiffness.

12. The method according to claim 2, further comprising modifying the resonant frequency of the blades by adding mass or varying the material from which the blades are made.

13. The method according to claim 12, wherein the blades are hollow or recessed, and said modifying is induced by filling in part of cavities with a material of an appropriate density.

14. The method according to claim 3, wherein a fillet between the blade and a hub varies from one blade to the next.

15. A method for introducing a deliberate mismatch into a turbomachine bladed wheel so as to reduce vibration amplitudes of the wheel in forced response, the method comprising the steps of:

statistically determining an optimum value of the standard deviation for the mismatch as a function of operating conditions of the wheel inside the turbomachine, with respect to the maximum vibration amplitude response required on the wheel, and at least partly placing blades with different natural frequencies on said wheel such that the standard deviation of the frequency distribution of all blades is equal to at least said mismatch value, calculating an average of damping coefficients corresponding to each possible phase angle between the blades, and checking that an aeroelastic damping of a mode concerned by floating is less than said average, to firstly determine if introducing a deliberate mismatch improves the aeroelastic stability.

* * * * *